US008293320B2

(12) United States Patent
Atanasova-Hoehlein et al.

(10) Patent No.: US 8,293,320 B2
(45) Date of Patent: Oct. 23, 2012

(54) METHOD FOR PRODUCING AN ELECTRICAL CONDUCTOR WITH AN INSULATION AND AT LEAST ONE POINT TO BE KEPT FREE OF THE INSULATION

(75) Inventors: Ivanka Atanasova-Hoehlein, Fuerth (DE); Ulrich Duellberg, Hirschberg (DE); Peter Heinzig, Wendelstein (DE); Bogdan Kokotowski, Oberasbach (DE); Konrad Unterlugauer, Buechenbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/313,480

(22) Filed: Dec. 7, 2011

(65) Prior Publication Data

US 2012/0076926 A1 Mar. 29, 2012

Related U.S. Application Data

(63) Continuation of application No. 11/667,212, filed as application No. PCT/EP2005/055724 on Nov. 3, 2005, now abandoned.

(30) Foreign Application Priority Data

Nov. 5, 2004 (DE) ..... 10 2004 054 527

(51) Int. Cl.

| | |
|---|---|
| ***B05D 5/12*** | (2006.01) |
| ***B05D 3/04*** | (2006.01) |
| ***B05D 1/18*** | (2006.01) |
| ***B05D 1/28*** | (2006.01) |

(52) U.S. Cl. ..... 427/117; 427/337; 427/282; 427/294; 427/427.5; 427/429; 427/434.6

(58) Field of Classification Search ..... 427/117, 427/337, 282, 294, 427.5, 429, 434.6
See application file for complete search history.

(56) References Cited

U.S. PATENT DOCUMENTS

| | | | | |
|---|---|---|---|---|
| 2,709,666 | A | | 5/1955 | Speekman |
| 2,819,181 | A | | 1/1958 | Thomas |
| 3,547,718 | A | * | 12/1970 | Gordon ..... 156/55 |
| 3,679,503 | A | * | 7/1972 | Dembiak et al. ..... 156/54 |
| 3,840,694 | A | * | 10/1974 | Luczak ..... 174/120 SR |
| 3,898,114 | A | | 8/1975 | Ward |
| 5,139,835 | A | | 8/1992 | Kitamura et al. |
| 5,294,249 | A | | 3/1994 | Luisi |
| 5,342,872 | A | | 8/1994 | Huber |
| 6,645,416 | B2 | | 11/2003 | Bock et al. |
| 6,713,522 | B2 | | 3/2004 | Zhang et al. |
| 6,964,989 | B1 | | 11/2005 | Fang et al. |

FOREIGN PATENT DOCUMENTS

| | | |
|---|---|---|
| DE | 868 015 | 2/1953 |
| DE | 40 350 | 8/1965 |
| DE | 23 37 462 A1 | 2/1975 |
| DE | 24 29 642 A1 | 1/1976 |
| DE | 31 44 337 A1 | 5/1983 |
| DE | 272 745 A1 | 10/1989 |
| DE | 92 08 213 U1 | 8/1992 |
| DE | 299 15 252 U1 | 4/2000 |
| DE | 100 23 208 A1 | 11/2001 |
| EP | 0 284 569 A1 | 9/1988 |
| FR | 2 241 129 A1 | 3/1975 |

OTHER PUBLICATIONS

Statement of Relevance for the Following Prior Art References: FR 2 241 129, DE 23 37 462 A1, and DE 92 08 213 U1.

* cited by examiner

*Primary Examiner* — Brian K Talbot
(74) *Attorney, Agent, or Firm* — Laurence A. Greenberg; Werner H. Stemer; Ralph E. Locher

(57) ABSTRACT

The conductor, including the points being kept free insulation, is initially surrounded by a liquid, electrically non-conducting bonding agent which forms the insulation after solidifying. The conductor can be a transposed conductor in which the individual conductors thereof are electrically isolated relative to each other and are interconnected by the bonding agent. Using a liquid stripping agent based on a polyvinyl alcohol or a long-chain hydrocarbon mixture and a polysaccharide filler on the point of the conductor being kept free of the insulation locally prevents the bonding agent from bonding to the conductor or the individual conductors of the transposed conductor from being interconnected by means of the unsolidified mixture. Once the entire bonding agent is hard and thus the bonding agent/stripping agent mixture has solidified, the bonding agent/stripping agent mixture can easily be removed in a mechanical manner from the treated points of the conductor.

11 Claims, No Drawings

METHOD FOR PRODUCING AN ELECTRICAL CONDUCTOR WITH AN INSULATION AND AT LEAST ONE POINT TO BE KEPT FREE OF THE INSULATION

CROSS-REFERENCE TO RELATED APPLICATION

This is a continuation application of application Ser. No. 11/667,212, filed Aug. 2, 2007; which was a continuation application, under 35 U.S.C. §120, of International application PCT/EP2005/055724, filed Nov. 3, 2005; the application also claims the priority, under 35 U.S.C. §119, of German patent application No. DE 10 2004 054 527.8, filed Nov. 5, 2004; the prior applications are herewith incorporated by reference in their entirety.

BACKGROUND OF THE INVENTION

Field of the Invention

The invention relates to a method for producing an electrical conductor that is provided with an insulation and has at least one point that is to be kept free of the insulation, wherein the conductor, including the points that are to be kept free, is initially surrounded with a liquid, electrically non-conducting bonding agent, in particular epoxy resin, and, after it has solidified, the liquid, electrically non-conducting bonding agent forms the insulation. Furthermore, the invention relates to a liquid release agent for a bonding agent, in particular epoxy resin, serving for the electrical insulation of conductors and/or for bonding individual conductors together to form one conductor, said release agent serving to prevent the bonding effect of the bonding agent in a selective and spatially defined manner.

In the production of electrical machines with winding arrangements, in particular transformers in the high-voltage area, the electrical and thermal conditions during operation of the electrical machine having to be taken into account in the configuration and production of the winding arrangements. For this reason, resin-encapsulated transformers are appropriate for use in the varied industrial and climatic conditions on account of the good thermal conductivity of the cured casting resin. Furthermore, so-called transposed conductors, which comprise a number of stacked individual conductors crossing one another, wherein the individual conductors are additionally electrically insulated from one another, are very often used for producing these winding arrangements.

To stabilize the individual conductors, they are adhesively bonded to one another, for example with epoxy resin, and, in conjunction with the stacked, crossed setup of the individual conductors, ensure great dimensional stability of the conductor. At the same time, in the case of transposed conductors, epoxy resin opens up the possibility of forming an adequate electrical insulating layer between the individual conductors after the curing on account of its electrical properties. The use of transposed conductors comprising a number of individual conductors for the winding arrangements of an electrical machine is therefore advantageous, since the setup of the transposed conductors significantly reduces the stray field losses during the operation of the transformer.

For example, DE 34 19 336 A2 discloses a method for producing transposed conductors for electrical machines, wherein, during the transposition of the individual conductors to form a single conductor, a pasty composition is applied to the conductor and this composition spreads into the interspaces between the individual conductors, so that, after the drying and consequent curing of the pasty composition, on the one hand a stable bond exists between the individual conductors and on the other hand the individual conductors are electrically insulated from one another. The epoxy resins used for this are usually enriched by additional chemical components or solid fillers, in order in this way to enhance the bonding and/or insulating properties of the epoxy resin between the individual conductors. By way of example, DE 102 24 587 A1 describes a casting composition which comprises a basic component and at least two additives, the first additive being synthetic silica flour. Chopped-strand glass materials and/or mineral fibers or silica flour are used as the second additive.

However, a disadvantage of all the previous prior-art methods is that, after the curing of the epoxy resin—consequently the stiffening of the conductor in its shape—certain parts of the winding arrangements can no longer be bent. Dimensional changing of the winding arrangements or certain points of the conductor of the winding arrangements that is necessary after the curing of the casting resin is no longer possible according to the prior art. Furthermore, the epoxy resin that has cured between the individual conductors as an insulator likewise prevents the possibility of electrical contacting between the individual conductors for a specific point of the winding arrangements or the conductors used, and this can only be restored after the curing of the epoxy resin by laborious removal of the cured, insulating bonding means from the conductor. In particular, the production of terminal contacting of the electrical machine with the outer electrical supply voltage leads requires complete contacting of all the individual conductors with the outer supply terminal. This has previously only been performed in a very laborious way as provided by the prior art.

According to the prior art, before the application of the epoxy resin to a transposed conductor in the region of the terminal contacts, the individual conductors are untwisted and separated from one another. After the application of the epoxy resin to the conductor of the winding arrangement and subsequent curing, individual conductors are twisted together again and manually intertwined in the region of the terminal contacts. However, these tasks can only be performed manually in a very laborious way and sometimes lead to electrical contacting of the conductors produced in this way that is not always reproducible.

Furthermore, it is known according to the prior art to use suitable solvents, in particular organic hydrocarbons, to strip the cured epoxy resin layer from the conductor in the region of the points where the terminal contacting is to be performed. It is disadvantageous that some of the solvents suitable for this are flammable and/or a health hazard. In addition, it must be ensured for the solvents that are used that they do not have any short-term or long-term chemical-physical influence on the constituent parts of the conductor or the winding arrangement.

A further alternative according to the prior art is that of burning off the cured epoxy resin coating from the point of the conductor of the winding arrangement that is to be contacted and the associated interspaces between the individual conductors of the point of the conductor that is to be contacted. The poisonous gases and toxic vapors produced by the evaporation of the epoxy resin must be captured and then disposed of, involving considerable cost. Furthermore, on account of the high temperatures necessary for this, burning off of the epoxy resin layer occurs not only in the region of the desired terminal contacting point but also in the surrounding regions, which then have to be laboriously coated again manually, and consequently re-insulated. Furthermore, the high temperatures can also adversely influence the electrical and mechanical properties of the individual conductors—and consequently of the conductor—on account of the high temperatures during the burning off.

SUMMARY OF THE INVENTION

The object of the present invention is therefore to provide a quick and easy possible way of producing an electrical conductor which is provided with an insulation and has at least one point that is to be kept free of the insulation, wherein the conductor is initially surrounded with a liquid, electrically non-conducting bonding agent, without the aforementioned disadvantages of the prior art.

The object is achieved by the characterizing features of the claimed method. According to the invention, it is provided that, after the application of the liquid bonding agent to the conductor, a liquid release agent is applied to the point of the conductor that is to be kept free. The bonding agent, in particular epoxy resin, already applied to the conductor but not cured is still in an uncured state—known as the B state—and is still in a highly viscous form. Without the addition of the liquid release agent, the heating of the uncured bonding agent would cause the viscosity to reduce and the bonding agent to liquefy, and in the case of a transposed conductor to flow into the interspaces of the individual conductors of the conductor, whereby the individual conductors are bonded to one another and insulated from one another. Without the release agent, the bonding agent would then bond together and cure to form a solid three-dimensional structure in the course of the heating process. The liquid bonding agent serves for insulating and/or bonding together individual conductors.

Liquid release agent as provided by the present invention comprises a great viscosity range from very low viscosities up to viscosities that define a virtually pasty composition.

The point that is to be kept free of the insulation as provided by the invention comprises all points of a conductor at which bonding and/or electrical insulation of the conductor or of individual conductors is not desired after the application of the bonding agent, for example since the points that are to be kept free still have to be bent or machined. After the application of the liquid release agent to the bonding agent in the B state, the entire conductor is then heated, and consequently the bonding agent and the mixture comprising bonding agent and release agent solidify. At the points of the conductor that are to be kept free of the insulation, to which the liquid release agent has been applied, no bonding effect has occurred between the individual conductors, since the mixture produced has prevented that. The liquid release agent diffuses through the uncured bonding agent and forms a mixture with changed chemical-physical properties in comparison with the exclusive uncured bonding agent. At a point that is to be kept free of the insulation and to which the liquid release agent has been applied, an exclusive sheathing around the conductor is formed by the mixture after the curing of the bonding agent. When the method is applied to transposed conductors, the individual conductors are not bonded to one another and/or insulated from one another by this method according to the invention. With this procedure, the bonding agent in the B state cannot penetrate into the interspaces of the individual conductors and bond them to one another and/or insulate them from one another. By the formation of the mixture, the liquid release agent prevents a transformation of the liquid bonding agent from the highly viscous B state to curing, and consequently fixing of this material state of the bonding agent.

It is preferred for the purposes of the present invention that the liquid release agent is brushed or sprayed onto the conductor in the region of the point that is to be kept free of the insulation and/or that the point of the conductor that is to be kept free of the insulation is immersed in the liquid release agent. For points of the conductor that are to be kept free over a large area, immersion of the corresponding points of the conductor in the liquid release agent is suitable. For locally very confined applications of the method according to the invention, spraying or brushing of the liquid release agent onto the point of the conductor that is to be kept free of the insulation is to be preferred. Forcing the liquid release agent between the individual conductors under high pressure is suitable as an application method, the liquid release agent taking the form of a pasty composition and being forced in under high pressure.

A further refinement of the method is that the liquid release agent is dried a little after application to the not yet cured bonding agent. This method step ensures that the liquid release agent applied to the liquid bonding agent prefixes the material state of the mixture produced in this way. The risk of segregation of the mixture produced in this way is consequently prevented and liquefying of no longer mixed components of the bonding agent does not occur in the subsequent actual heating and curing. In particular in the case of transposed conductors, there is the risk that, without pre-drying of the mixture produced, the mixture could flow into the interspaces between the individual conductors and adhesively bond them.

With preference, the liquid release agent contains polyvinyl alcohol. Alternatively, the release agent contains as a basic compound long-chain hydrocarbon mixtures. All oils and oil mixtures that are used in transformer construction are advantageously used as long-chain hydrocarbon mixtures, since, in view of their chemical-physical compatibility, these have already been in use for decades in transformer construction and can therefore be used without concern in the context of the method according to the invention.

Furthermore, to influence the degree of viscosity of the liquid release agent, water is likewise added to the liquid release agent. In addition, the liquid release agent contains alcohol components in the form of a primary, secondary or tertiary alcohol or an alcohol mixture.

The liquid release agent preferably contains a filler based on a polysaccharide, which is in a grain size of from 1 μm to 500 μm, with preference from 30 μm to 90 μm.

In an advantageous refinement of the method according to the invention, there is within the liquid release agent a preferred mixing ratio of polyvinyl alcohol or long-chain hydrocarbon mixtures and water of from 1:5 to 1:20. Alcohol is added to the release agent as a solvent, it being possible for the proportion of alcohol in the polyvinyl alcohol/water mixing ratio to vary greatly in accordance with the desired solvent properties. With preference, alcohol is added to the polyvinyl alcohol/water mixture or the long-chain hydrocarbon mixture/water mixture in proportions of from 1:1 to 5:1 in relation to the basic compound of polyvinyl alcohol or long-chain hydrocarbon mixtures. According to the invention, there is a ratio of the liquid mixture to the solid filler of from 10% by volume to 70% by volume.

The object is likewise achieved according to the invention by the features of a liquid release agent. According to the invention, a liquid release agent for a bonding agent is for the electrical insulation of conductors. In particular in the case of transposed conductors, the individual conductors are bonded to one another and electrically insulated from one another by the bonding agent. The release agent in this case contains the following components: polyvinyl alcohol, water, alcohol and a filler based on a polysaccharide. According to the invention, a mixing ratio of the polyvinyl alcohol and the water of from 1:1 to 1:20 is preferred. Alcohol is added to the polyvinyl alcohol/water mixture in proportions of from 1:1 to 5:1 in relation to the polyvinyl alcohol. The filler is likewise in a preferred grain size of from 1 μm to 500 μm, with preference from 30 μm-90 μm. The ratio of the liquid mixture to the solid filler is with preference 10%-70%.

Alternatively, the liquid release agent comprises long-chain hydrocarbon mixtures with a boiling point of between 80° C. and 300° C., water, alcohol and a filler based on a polysaccharide. All oils and oil mixtures that are used in transformer construction are used with preference as long-chain hydrocarbon mixtures, since they can be used without concern as a basis for the release agent according to the invention. According to the invention, a mixing ratio of the hydrocarbon mixture and the water of from 1:1 to 1:20 is preferred. Alcohol is added to the hydrocarbon/water mixture in proportions of from 1:1 to 5:1 in relation to the hydrocarbon mixture. Likewise, the filler is in a preferred grain size from 1 μm to 500 μm, with preference from 30 μm-90 μm. The ratio of the liquid mixture to the solid filler is with preference 10% by volume to 70% by volume.

An example of a composition of the release agent according to the invention is described below. The release agent in this case comprises polyvinyl alcohol which is mixed with 40% by volume of the primary alcohol ethanol. To influence the viscous properties of the release agent, water is added to it with 50% by volume. A filler of cellulose is added to this mixture, wherein the grain size of the cellulose is 250 μm and it is in a proportion as a percentage by volume with respect to the release agent of 50% by volume. All forms of primary, secondary and tertiary alcohols may be used as the alcohol. Furthermore, all possible forms of cellulose in pure or modified form that have a grain size of an appropriate degree may be used. A particular advantage of this method is that organic solvents are avoided for the removal of the epoxy resin. Furthermore, in the case of the present invention it is advantageous that all the materials used are customary in transformer construction and have been approved for years or decades, so that any remaining residues of the release agent or of constituent parts of the release agent do not lead to any impairment of the functional capability, operating behavior and/or service life of the transformer.

The invention claimed is:

1. A method for producing an electrical conductor with an insulation and at least one point to be kept free of the insulation, the method which comprises:

initially surrounding the conductor, including the points to be kept free of insulation, with a liquid, electrically non-conducting bonding agent;

applying a liquid release agent to the liquid bonding agent at the point of the conductor to be kept free of insulation, to form a mixture of bonding agent and release agent;

subsequently solidifying the electrically non-conducting bonding agent with the mixture to form the insulation on the conductor; and mechanically removing the mixture from the point of the conductor to be kept free of insulation.

2. The method according to claim 1, wherein the conductor comprises a plurality of individual conductors, and the method comprises adhesively bonding the individual conductors to one another and electrically insulating the individual conductors from one another by the bonding agent.

3. The method according to claim 1, wherein applying the liquid releasing agent includes brushing or spraying the liquid release agent onto the not yet cured bonding agent in the region of the point to be kept free of the insulation, immersing the point of the conductor to be kept free of the insulation in the liquid release agent or forcing the liquid release agent under pressure.

4. The method according to claim 1, which comprises, after applying the liquid release agent to the not yet cured bonding agent, drying the mixture.

5. The method according to claim 1, wherein the liquid release agent contains polyvinyl alcohol or long-chain hydrocarbon mixtures.

6. The method according to claim 5, wherein, in addition to the polyvinyl alcohol or the long-chain hydrocarbon mixtures, the liquid release agent contains water and alcohol.

7. The method according to claim 5, which comprises providing the liquid release agent with a filler based on a polysaccharide.

8. The method according to claim 7, wherein the filler has a preferred grain size from 1 μm to 500 μm.

9. The method according to claim 7, wherein the filler has a grain size from 30 μm to 90 μm.

10. The method according to claim 6, wherein the liquid release agent has a mixing ratio of polyvinyl alcohol or long-chain hydrocarbon mixtures and water from 1:5 to 1:20, and alcohol added in proportions from 1:1 to 5:1 in relation to the polyvinyl alcohol or in relation to the long-chain hydrocarbon mixture.

11. The method according to claim 8, wherein a ratio of the liquid mixture to the filler lies between 10% by volume and 70% by volume.

* * * * *